United States Patent [19]

Esterly

[11] 3,967,519

[45] July 6, 1976

[54] MULTI DIRECTIONAL WEB CUTTER

[76] Inventor: Harry F. Esterly, 47 Rowley Road, Topsfield, Mass. 01983

[22] Filed: July 16, 1974

[21] Appl. No.: 488,962

[52] U.S. Cl. ..... 83/455; 83/486.1; 83/522; 83/561; 83/652; 83/6

[51] Int. Cl.[2] ..... B26D 1/02

[58] Field of Search ..... 83/455, 485, 486, 486.1, 83/563, 574, 581, 582, 561, 614, 6

[56] References Cited

UNITED STATES PATENTS

| | | | |
|---|---|---|---|
| 3,469,488 | 9/1969 | Gaspari | 83/652 |
| 3,522,753 | 8/1970 | Schmied | 83/471 |
| 3,527,131 | 9/1970 | Ellerin | 83/522 |
| 3,626,799 | 12/1971 | Gerber | 83/561 |

*Primary Examiner*—Donald R. Schran
*Attorney, Agent, or Firm*—Thomas C. Stover, Jr.

[57] ABSTRACT

An apparatus which cuts web, eg mat board, in several directions is provided, which includes a knife carriage which rides on moveable rails over the mat board, the knife carriage having mounted thereon a rotatable blade assembly which indexes the blade to four 90° positions. The blade is retractably mounted in the blade assembly at preferably a bevel angle. Accordingly, the apparatus can rapidly cut a rectangular mat board picture frame or cut or score other patterns.

19 Claims, 7 Drawing Figures

MULTI DIRECTIONAL WEB CUTTER

FIELD OF THE INVENTION

This invention relates to a web cutter, particularly a multi-directional web cutter.

THE PRIOR ART

Cutting web for border or framing purposes is a widespread industry. For example, in cutting mat board for picture framing, skill and suitable tools are required to cut the desired edge therethrough. To this end, several patents have been issued directed to mat cutting devices, e.g. U.S. Pat. No. 3,130,622 to Eno, U.S. Pat. No. 3,463,041 to Shapiro, U.S. Pat. No. 3,213,736 to Keeton and U.S. Pat. No. 3,527,131 to Ellerin et al. With such mat cutting devices, a rectangular mat opening is cut one side at a time. The opening is first marked on the mat, then the mat must be turned and realigned with an edge guide for cutting each of the sides. This is a time consuming procedure and there is a need and market for a web cutting device which quickly cuts the web as desired.

There has now been developed a web cutting apparatus wherein a multi-sided figure is quickly cut into the web without having to reposition or mark the same. For example, a rectangular opening for a picture frame can be quickly cut in mat board. Moreover, the cut can be straight or beveled.

SUMMARY

Broadly, the present invention provides a web cutting apparatus comprising means for holding the web on a support surface; a pair of spaced tracks mounted on said support surface; at least one other cross track positioned across said pair of tracks and moveably mounted thereon to slide laterally along said pair of tracks to and fro; a knife carriage moveably mounted on said cross track; a rotatable blade assembly mounted on said carriage, the blade positioned to contact the web thereunder to cut the same; means for rotating said blade assembly to cut said web in a plurality of directions; means for moving said knife carriage along said cross track and means for moving said cross track along said pair of tracks so as to move said blade a plurality of directions over said web to cut the same.

DESCRIPTION

The invention will become apparent from the following detailed specification and drawings in which.

Figure 1:
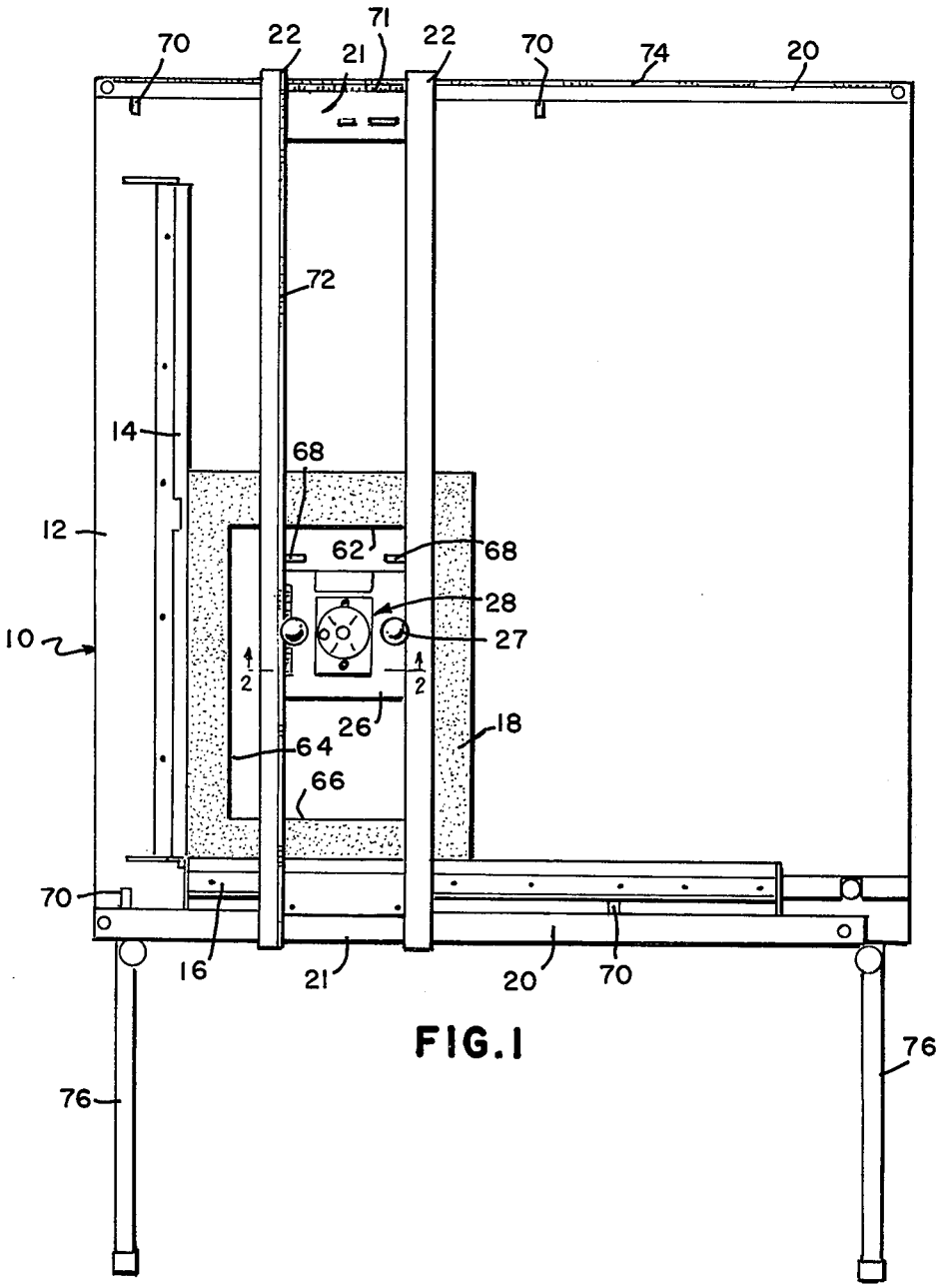
FIG. 1 is a plan view of a web cutting apparatus embodying the present invention.

Referring in detail to the drawings, multi-directional mat cutting apparatus 10, having support surface 12, has hold-down bars 14 and 16, which secure mat 18 thereto as shown in FIG. 1. Mounted on this support means 12 at opposed edges thereof is a pair of X-axis rails 20. Mounted across these X-axis rails 20 are a pair of Y-axis rails 22 joined by ties 21, which rails 22 travel on the rails 20 by means of rollers 24, as illustrated in FIGS. 1, 2, 4 and 5.

Mounted on the Y-axis rails 22, is knife carriage 26 containing rotatable blade assembly 28 thereon as shown in FIGS. 1, 2, 3 and 4. The knife carriage 26 having rollers 30, travels to and fro on Y-axis rails 22.

Figure 2:
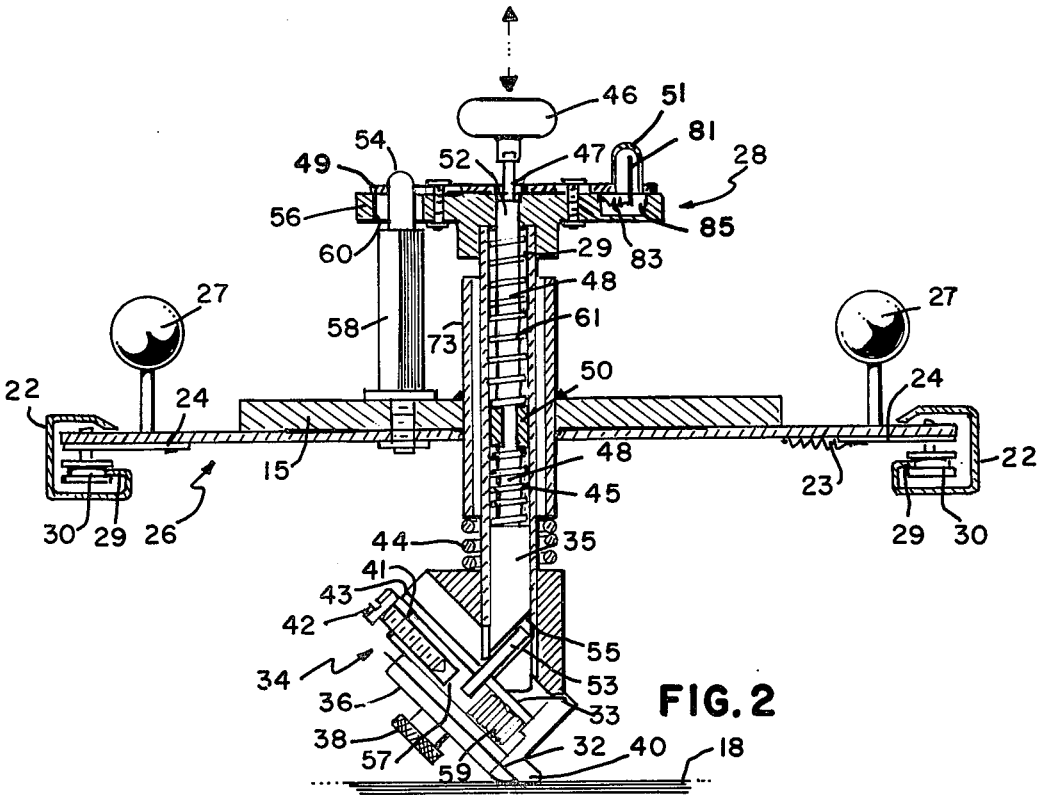
FIG. 2 is a sectional elevation view of a component of the embodiment of FIG. 1 taken on line 2—2 looking in the direction of the arrows.
Figure 4:
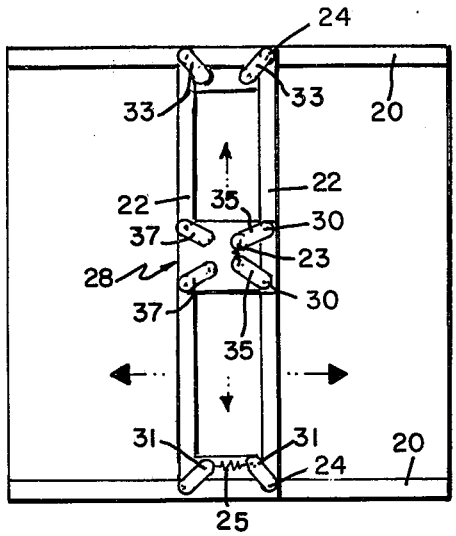
FIG. 4 is a bottom schematic plan view of a portion of the embodiment of FIG. 1.
Figure 5:
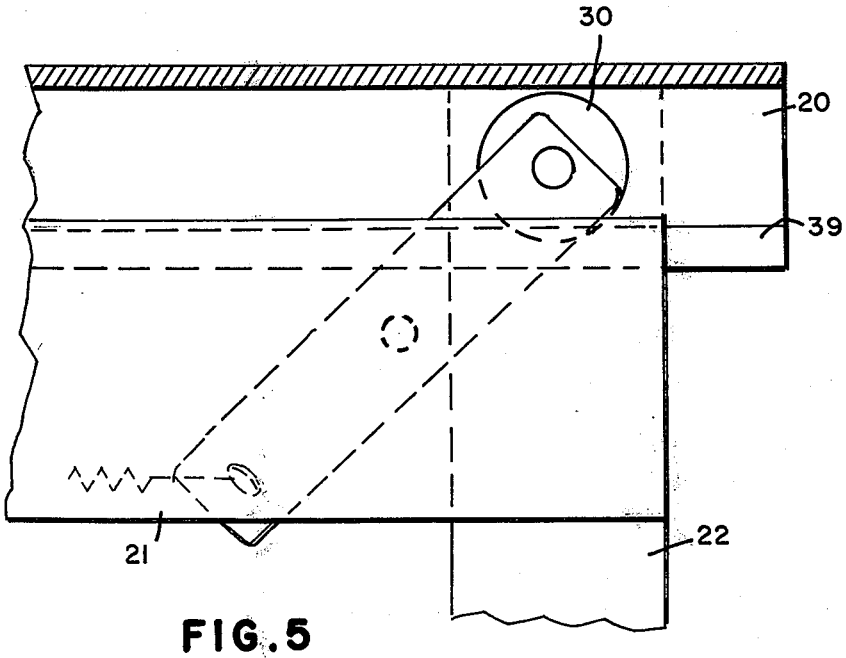
FIG. 5 is an enlarged fragmentary view, partly in section, of a portion of the embodiment illustrated in FIG. 4.
Figure 6:
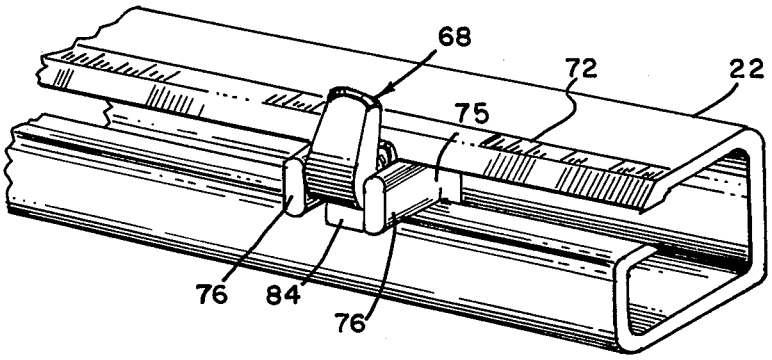
FIG. 6 is an enlarged isometric projection of components of the embodiment illustrated in FIG. 1.

The X and Y axis rails 20 and 22 are channel shaped as shown respectively in FIGS. 2, 5 and 6. The Y-axis rails 22 ride on 2 pair of rollers 24 on the X-axis rails 20, and the blade assembly 28 rides on the Y-axis rails 22 on 2 pair of rollers 30 as shown in FIGS. 2, 4 and 5. Each roller is mounted on stationary arms respectively 33 and 37, and on pivotable arms 31 and 35 as shown in FIG. 4. The pivotable arms 31 and 35 are joined respectively by springs 25 and 23 to ensure close gripping of rollers 24 and 30 in the rails 20 and 22 as shown in FIGS. 4 and 5. The rollers 24 and 30 have grooved surfaces, which ride on the matching ridges 29 and 39 of their associated rails 20 and 22 as shown in FIGS. 2 and 5.

Figure 3:
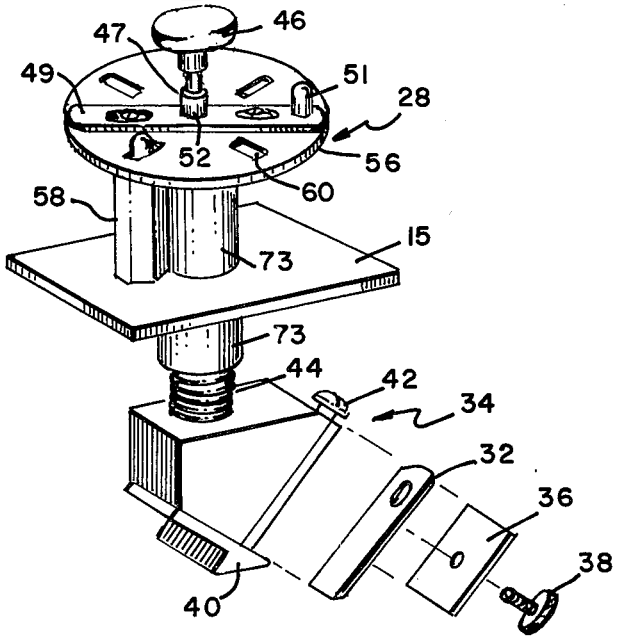
FIG. 3 is an isometric exploded view of a portion of the component of FIG. 2.

The rotatable blade assembly 28 has blade 32 supported in blade housing 34 by blade clamp 36 and thumb screw 38 as shown in FIGS. 2 and 3. The blade housing 34 rides on the surface of the mat 18 on foot 40. The blade 32 is held at a 45 degree bevel angle in the blade housing 34 and a depth of penetration of the blade beyond the foot 40, is controlled by blade depth adjustment screw 42, as shown in FIGS. 2 and 3. The blade housing 34 is resiliently held against the mat surface by helical spring 44. Pressure knob 46 is mounted on upper push rod 48 which passes through centering sleeve 50 and applies pressure to helical spring 45, and lower push rod 35 and the blade 32, as hereinafter explained, such that application of e.g. hand pressure to knob 46, compresses spring 45 and drives blade 32 into the mat board.

The lower push rod 35 has a diagonal tunnel 55 therethrough. Mounted below the lower push rod 35 on a converging diagonal with respect thereto, is blade slide 57 on which is mounted the blade 32 and slide stem 53 which extends at an angle with the blade slide 57 into the tunnel 55 in sliding engagement therewith as shown in FIG. 2. The lower push rod 35 moves down and up in channel 33. The blade slide 57 moves back and forth in channel 41 against helical spring 59 shown in FIG. 2. The extent of downward motion of the blade slide 57 is limited by the setting of screw 42, the head of which strikes shoulder 43 to limit the downward position of said slide and thus the blade 32. Thus, advancing the screw 42 into the blade slide 57 decreases the depth of penetration of the blade 32 into the mat board while (partly) withdrawing the screw 42, increases such penetration.

In operation, the knob 46 and upper push rod 48 is depressed whereupon the spring 45 and the push rod 48 pushes lower push rod 35 downwardly, which, in turn pushes downwardly on slide stem 55 and blade slide 57, causing it to advance in its channel 47 against spring 59 and extend the blade 32 out of the foot 40, while, above, the detent lever 49 engages knob slot 47, as described below and locks the blade 32 in the down position, as illustrated in FIG. 2.

The detent lever 49 has hollow handle 51 within which is mounted spire 81, which extends below such handle to helical spring 83, mounted within slot 85 of the index plate 56 as shown in FIG. 2. The spring is mounted to push against the handle 51 to resiliently urge it toward the right as illustrated in FIG. 2.

Accordingly, the blade 32 is maintained in the down position by depressing knob 46 until the knob slot 47 is depressed to the level of detent lever 49, having handle 51 and aperture 52, such that when knob 47 aligns with lever aperture 52, the detent lever 49 is displaced sideways, by the spring 83 above, so that it engages knob slot 47 and locks same in place.

The cut is made in the mat 18, after which the detent lever 49 is displaced, releasing the downward pressure on the respective push rods. Upon release of such pressure, spring 59 suddenly pushes slide 57 (and slide stem 53), upwardly in the channel 41, retracting the blade 32 from the mat 18, while the slide stem 53, in the tunnel 55, pushes the respective push rods and the knob 46 upwardly with respect to the index plate 56 and against the cushion spring 61, so that the blade assembly 28 springs to the retracted position, as illustrated in FIG. 3. Thus, while the knob 46, push rods 48 and 35 and push rod spring 45 reciprocate vertically in housing tube 29, the spring 59, blade slide 57 and blade 32 reciprocate diagonally as guided by channel 41.

Note that when the blade assembly 28 springs to the retracted position as above described, the foot 40 of the blade housing 34 is still pressed against the mat surface 18 by external spring 44. The foot 40 is raised off the mat 18 as discussed below.

The rotatable blade assembly 28 is positioned in the various four cutting directions by indexing means 54 which engages apertures 60 on the indexing plate 56. The rotatable blade assembly 28 is moveable upwardly against spring 44 with respect to the knife carriage 26, carriage base plate 15 and housing tube 73, which raises the foot 40 upwardly with respect to the mat 18. Accordingly, the assembly can be lifted by the index plate 56 (e.g. by hand), relative to the knife carriage 26 to rotate the assembly, with the index plate 56 above the pin 54, to index same to the next cutting position. When the desired aperture 60 is brought into registration with the indexing means 54, the indexing plate 56 is then lowered into place as shown in FIGS. 2 and 3.

The rotatable blade assembly 28 is carried on the knife carriage 46 which can travel in the X and Y directions on the rails 20 and 22 as aforesaid.

In this way, the knife carriage 26 can move in all directions over the mat board 18 in the manner of coordinator graph and the mat 18 can be cut in the usual rectangular inside opening, having sides 62, 64, 66 and the like as shown in FIG. 1. These cuts are made in four rapid steps by the blade 32, which is rotated 90 degrees between each cut. The blade 32 is lowered into the mat and locked by depressing knob 46 and displacing detent lever 49 as aforesaid. The knife is then moved over the respective rails, cutting the mat 18 in the desired direction.

Stops 68 and 70 limit the extent of the cut in the desired direction. Linear scales 72 and 74, assist in measurements and positioning of the Y-axis rails and knife carriage 26 as shown in FIG. 1. After the cutting step, the blade 32 is released and raised out of the mat surface 18 by displacing detent lever 49, after which the indexing plate 56 and the blade assembly 28 are lifted (by hand), off the mat board, and rotated and indexed for the next cutting step. After the final cutting step, the indexing plate 56 and the blade assembly 28 are again lifted and partially rotated so that the indexing plate 56 rests atop the indexing pin 54 and the mat board is readily removed thereunder.

Figure 7:
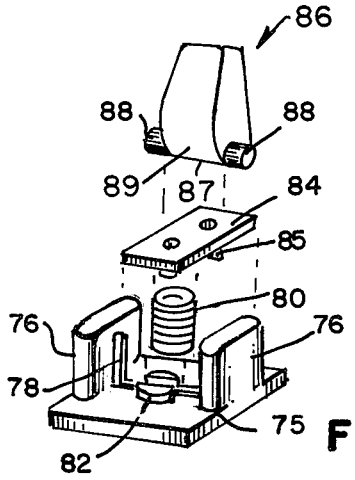
FIG. 7 is an exploded isometric view of a component illustrated in FIG. 6.

The stops 68 and 70 are positioned in the rails 20 and 22 as shown in FIGS. 1 and 6. Each stop has a base plate 75, a pair of upright arms 76 with cam slots 78 therein, a release spring 80 which is mounted on a split pedestal 82, surmounted by a spring block 84 (which has a spring engaging means 85 thereunder), as shown in FIGS. 5 and 6. The spring block 84 is held against the cam spring 80 by cam lever 86 which has pivot arms 88 which are positioned into the cam slots 78 as shown in FIGS. 6 and 7. The cam lever 86 has a flat base 87 and wider rounded sides 89 such that when the cam lever 86 is positioned cross-wise with respect to the upright arms 76, the spring block 84 is pressed against the rail 22 locking the stop in place as shown in FIG. 6. When the cam lever 86 is pivoted outwardly with respect to the arms 76, the spring block is urged by the spring 80 away from the rail 22, freeing the stop 68 for relocation.

Knobs 27, mounted on knife carriage 26 provide manual grips for moving the carriage to and fro on the rails 22 and the index scale 29 mounted on the carriage 26 aligns with opposite scale 72 specifying the position of the knife carriage 26 as shown in FIGS. 1 and 2. Similarly, index scale 71 aligns opposite scale 74, specifying the position of the Y-axis rails 22, as shown in FIG. 1.

By the above described apparatus of the invention, a mat suitable for framing purposes can be cut with a beveled rectangular opening, for example, in about 30 seconds, where the same process, by the laborious techniques of prior art apparatus now in use, require about five minutes.

The mat cutter of the invention can be mounted on a table surface or other surface in a horizontal or slanted manner, but preferably is mounted vertically against a wall or on legs, e.g. legs 76 as shown in FIG. 1.

Thus, the multi-directional speed mat cutter of the present invention can cut mat in the X and Y directions, as discussed, and can also cut the mat in all directions to obtain the cut desired. The number of the index apertures in the indexing plate 56 influences the number of directions of the cut in the mat.

The multi-directional mat cutter of the present invention is used to cut mat of various types, including cellulose surfaces, e.g. paper, cardboard, mat board, fiber board, wood and various other cuttable boards, including artificial and laminated panels and also other materials such as glass, plastic and the like. Thus, the invention can be employed to cut virtually any sheet or material susceptible to scoring or cutting in this manner.

The X-axis tracks or rails should be at least two in number, spaced apart across a substantial portion of the support surface. The Y-axis tracks or rails can be one or more in number, which extends across the two or more X-axis tracks or rails and which slide or roll thereacross. The knife carriage then rides on or beside the respective Y coordinate track or plurality thereof. The knife carriage rides on wheels or can slide on the respective track or tracks.

Alternatively, one or more X-axis rails can move across at least two spaced apart Y-axis rails. In such case, the knife carriage would ride on the X-axis rail or rails.

The stops can be positioned on the respective track or rails in slideable engagement therewith, with means to position the same at a fixed location, including levers, (as shown in FIGS. 6 and 7), thumb screws or wing nuts and the like.

Various shaped rails, tracks, bearings and springs can be employed with the mat cutter embodying the present invention.

Any means can be employed to secure the web on the support surface, including the clamps illustrated, or other clamps, including C-clamps, staples, tape, glue, thumb tacks and the like.

The knife can be supported in a bevel angle to cut the web accordingly or can be supported at an angle perpendicular to the web being cut, as desired.

The method of positioning the blade carriage 34 and thus the knife 32, can be the indexing means illustrated or can be other indexing means, including screw thread, clamp or other means within the scope of the present invention.

What is claimed is:

1. A web cutting apparatus comprising means for holding the web on a support surface; a pair of spaced tracks mounted on said support surface; at least one other cross-track positioned across said pair of tracks and moveably mounted thereon to slide laterally along said pair of tracks to and fro; a knife carriage moveably mounted on said cross track; a rotatable blade assembly rotatably mounted on said carriage; (a blade mounted on said blade assembly and positioned to contact the web thereunder to cut the same;) means for rotating said blade assembly to cut said web in a plurality of directions; said blade assembly having resiliently mounted at the base thereof a blade guide means, said guide means terminating in a smooth surfaced foot for riding over the web, said guide means having a blade mounted thereon and penetrating beyond said foot and means for adjusting the depth of penetration of said blade beyond said foot; means for moving said knife carriage along said cross-track and means for moving said cross-track along said pair of tracks so as to move said blade a plurality of directions over said web to cut the same.

2. The web cutting apparatus of claim 1 wherein said cross-track is mounted at right angles with said pair of tracks.

3. The web cutting apparatus of claim 1 having two spaced cross-tracks mounted across said pair of tracks.

4. The web cutting apparatus of claim 1 wherein at least one marginal web clamp secures the web to said support.

5. The web cutting apparatus of claim 1 wherein said pair of tracks are mounted in spaced parallel relationship proximate opposed edges of said web.

6. The web cutting apparatus of claim 1 having a calibrated scale mounted along at least one of said tracks.

7. The web cutting apparatus of claim 1 having at least one stop means positioned on at least one of said tracks to stop said carriage after making a predetermined cut in said web.

8. The web cutting apparatus of claim 1 wherein said rotatable blade assembly has locking means to radially index said assembly and its blade in a plurality of positions.

9. The web cutting apparatus of claim 1 wherein said blade is mounted on said blade assembly at an angle with said web to cut said web in a bevel cut.

10. The web cutting apparatus of claim 1 wherein said knife carriage moves over said track on roller means.

11. The web cutting apparatus of claim 1 wherein said knife carriage has at least one handle for manual guidance of same.

12. The web cutting apparatus of claim 1 wherein said support surface is mounted vertically and carries said tracks and said cros-track thereon.

13. The web cutting apparatus of claim 1 wherein said web is selected from the group consisting of mat board, paper, glass and plastic.

14. The web cutting apparatus of claim 1 wherein said blade is mounted to a blade slide member to slide at an acute angle with the surface of said web, extension means for sliding said blade toward said web to penetrate beyond said foot for web cutting purposes and retracting means for sliding said blade away from said web to retract said blade.

15. The web cutting apparatus of claim 1 wherein locking means lock said blade in the penetrating position, and releasing means release said lock and permit said blade to retract, said retracting means being a spring.

16. The web cutting apparatus of claim 1 wherein said extension means is at least one push rod which moves back and forth in a path substantially normal to said web in engagement with said blade slide member, which moves back and forth at an acute angle with said path.

17. The web cutting apparatus of claim 1 having handle means for lifting said blade assembly, including said blade guide means off said web and relative to said knife carriage to permit free movement between said blade assembly and said web, including rotational indexing of said blade assembly.

18. The web cutting apparatus of claim 1 having means to index said blade assembly at four 90° intervals.

19. A web cutting apparatus comprising means for holding the web on a support surface; a pair of spaced tracks mounted on said support surface; at least one other cross-track positioned across said pair of tracks and moveably mounted thereon to slide laterally along said pair of tracks to and fro; a knife carriage moveably mounted on said cross-track; a rotatable blade assembly rotatably mounted on said carriage; a blade mounted on said blade assembly and positioned to contact the web thereunder to cut the same; means for rotating said blade assembly to cut said web in a plurality of directions; means for moving said knife carriage along said cross-track and means for moving said cross-track along said pair of tracks so as to move said blade a plurality of directions over said web to cut the same; carriage stops mounted on at least some of said tracks: each stop having a base plate; a spaced pair of projecting arms extending from said base plate; a compressible coil spring mounted on said base plate between said arms; a gripper plate mounted between said arms on said spring, a cam lever pivotably mounted between said arms against said gripper plate, said cam lever being thicker with respect to its pivot axis on at least one side than at the base thereof such that pivoting said lever to bring said side into contact with said gripper plate advances the latter toward said base plate to grip a track situated therebetween and pivoting said lever to bring its base into contact with said gripper plate permits said gripper plate to withdraw from said base plate under pressure of said spring, releasing said stop for repositioning same along said track.

* * * * *